US005486906A

United States Patent [19]

Tsuneeda et al.

[11] Patent Number: 5,486,906

[45] Date of Patent: Jan. 23, 1996

[54] CONTACT CHARGER AND IMAGE FORMING APPARATUS COMPRISING THE SAME

[75] Inventors: Kenichi Tsuneeda, Yokohama; Sachiko Yoshida; Masato Ogasawara, both of Tokyo, all of Japan

[73] Assignee: Kabushiki Kaisha Toshiba, Kawasaki, Japan

[21] Appl. No.: 194,524

[22] Filed: Feb. 10, 1994

[30] Foreign Application Priority Data

Mar. 23, 1993 [JP] Japan ..... 5-062366

[51] Int. Cl.[6] ..... G03G 15/02

[52] U.S. Cl. ..... 355/219; 361/225

[58] Field of Search ..... 355/219; 361/225; 430/902

[56] References Cited

U.S. PATENT DOCUMENTS 4,371,252 2/1983 Uchida et al. ..... 355/219

5,012,282 4/1991 Wanou et al. ..... 355/219

FOREIGN PATENT DOCUMENTS 4-51168 2/1992 Japan ..... 355/219

*Primary Examiner*—Joan H. Pendegrass

*Attorney, Agent, or Firm*—Foley & Lardner

[57] ABSTRACT

A contact charger is in contact with a photosensitive body to charge the photosensitive body. Conductive nonwoven fabric is in surface-contact with the photosensitive body. A voltage is applied to the conductive nonwoven fabric through a conductive holder. The conductive nonwoven fabric has a surface resistivity of $10^5$ to $10^7$ Ω/□, so that the photosensitive body can be charged to a predetermined potential with little charge unevenness.

24 Claims, 5 Drawing Sheets

CONTACT CHARGER AND IMAGE FORMING APPARATUS COMPRISING THE SAME

BACKGROUND OF THE INVENTION

1. Field of the Invention

The present invention relates to a contact charger for charging an image carrying body while being brought into contact with the image carrying body, and an image forming apparatus comprising the contact charger.

2. Description of the Related Art

A brush charger disclosed in U.S. Pat. No. 5,012,282 is known as a conventional contact charger. The brush charger comprises a conductive base and conductive brush fibers in contact with the conductive base. A charging voltage from a power supply is applied to the surface of a photoconductive drum.

A brush charger of this type has a drawback of unevenness in charge, as will be described below.

First, if the density of brush fibers implanted into the conductive base is low, the probability of the brush fibers being in contact with the photosensitive drum is also low, thereby causing minute unevenness in charge. Since it is difficult to manufacture a brush charger having an increased density of the brush fibers, the width of the brush is increased to increase the probability of the brush fibers being in contact with the photosensitive drum. However, it is difficult to increase the probability of the brush fibers being in contact with the photosensitive drum per unit time, in consideration of the space in which the charger is mounted.

Secondly, the brush charger is likely to catch fine toner after cleaning or dust adhered to the surface of the drum. Further, in a static boundary of the drum (the portions of the drum which correspond to the front and the rear ends of a paper sheet), the toner or dust adhered to the brush is discharged to the surface of the drum again. The toner or dust adheres to an output image as contaminant.

Thirdly, brush fibers may be removed from the base owing to incomplete implanting of the fibers in the manufacturing step, or mechanical or static factors during an operation. Removed fibers may be transferred to apparatuses in the other image-forming processes, e.g., a developing apparatus or a transferring apparatus, resulting in various problems such as a leak or a minute gap.

Fourthly, brush fibers are generally made of rigid chemical fibers. Since rigid fibers abut on the photosensitive drum, the surface of the photosensitive drum is etched by the sharp edges of the fibers. The thickness of the etched portion of the drum is reduced, resulting in various problems, e.g., reduction in the charge potential and imperfect cleaning due to local etching. Thus, the lifetime of the drum may be greatly reduced. Further, the etched-off portion of the drum surface may adhere to the distal ends of the fibers, with the result that uniform charge cannot be achieved.

Finally, in a brush charger, the amount of deformation of the end portions of the fibers and the charge potential have a proportional relationship. Therefore, to obtain a constant potential, the amount of the deformation must be uniform over the length of the drum. However, it is difficult to cut fibers precisely to the extent that the charge potential is not influenced. Further, the attachment accuracy of the brush charger with respect to the photosensitive drum and the bent of the fibers may cause charge unevenness, which influences an output image.

SUMMARY OF THE INVENTION

The present invention has been made to overcome the above problems, and its object is to provide an inexpensive contact charger which is uniformly brought into contact with an image carrying body, i.e., a photosensitive drum, to prevent unevenness in charge, increase the mechanical strength, prevent the fibers from being cut or removed from the base owing to friction to the image carrying body, and avoid contamination during an image output process. Another object of the present invention is to provide an image forming apparatus comprising the contact charger.

According to the present invention, there is provided a contact charger for charging an object, comprising:

conductive nonwoven fabric in surface contact with the object; and voltage applying means for applying a voltage to the conductive nonwoven fabric so as to charge the object.

There is also provided an image forming apparatus, comprising:

charging means for charging a photosensitive body, the charging means comprising conductive nonwoven fabric in surface contact with the photosensitive body and voltage applying means for applying a voltage to the conductive nonwoven fabric;

exposing means for exposing the photosensitive body charged by the charging means, so as to form a latent image on the photosensitive body; and developing means for supplying a developer to the photosensitive body on which the latent image is formed, thereby forming a developed image on the photosensitive body.

In the contact charger of the present invention, when a voltage is applied to the conductive nonwoven fabric in surface contact with an image carrying body, the image carrying body is charged. Since the nonwoven fabric is in surface contact with the image carrying body, unevenness in charge is prevented and the image carrying body can be uniformly charged.

Then, a latent image is formed on the charged image carrying body by the exposing means. A developer is adhered by means of the developing means to the image carrying body on which the latent image is formed, thereby forming a developed image on the image carrying body. The developed image is transferred to a transfer medium by transfer means, and the transferred image is fixed to the transfer medium by fixing means.

It is preferable that the surface resistivity of the conductive nonwoven fabric be $10^5$ to $10^7$ Ω/□, for the following reasons, clarified through the study of the present inventors when the surface resistivity exceeds $10^7$ Ω/□, the charge becomes uneven. The unevenness in charge may be presented as fog like black belts in the longitudinal directions on an image or unevenness in diameters in dots of a mesh image. When the surface resistivity is $10^5$ Ω/□ or less, an over-current flows through pin holes of the photosensitive body, resulting that the charge potential is reduced and the conductive nonwoven fabric itself is burned. Thus, safety is not ensured. Moreover, the burned portion loses a charging function and cannot charge the image carrying body, resulting in a black belt produced on an image transfer medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the contact charger and the image forming apparatus of the present invention will now be described with reference to the accompanying drawings.

Figure 1:
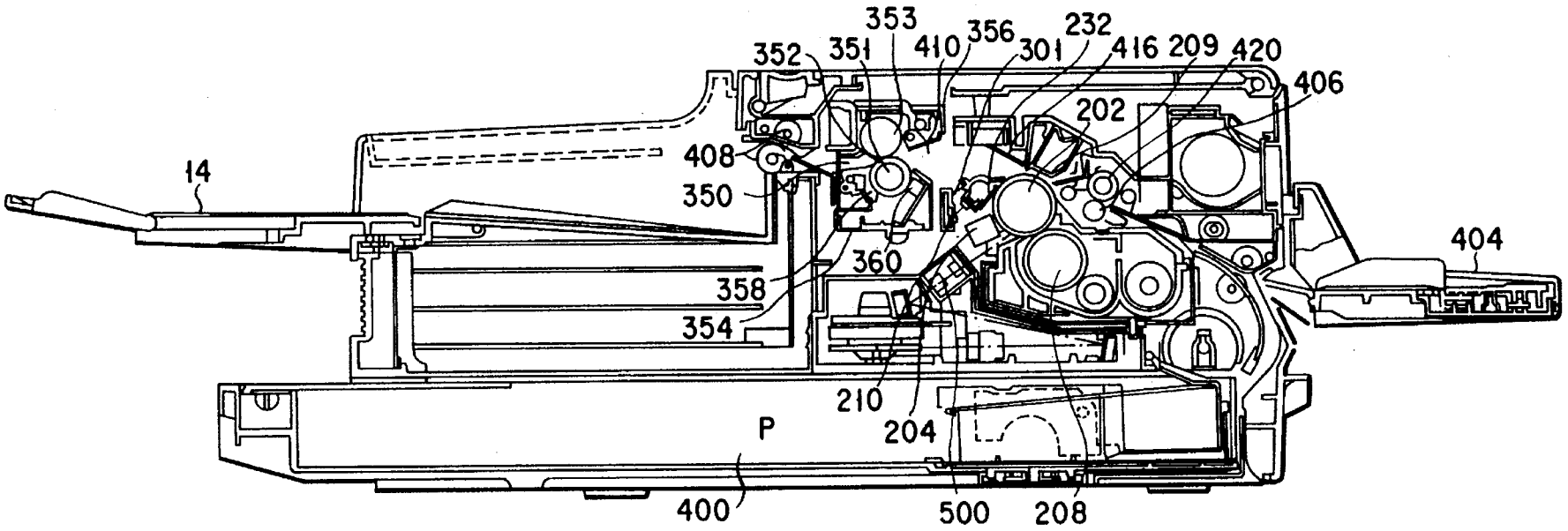
FIG. 1 is a schematic diagram showing an image forming apparatus according to the present invention.

FIG. 1 shows an image forming apparatus, which comprises a drum photosensitive body 202. The photosensitive body 202 serves as an image carrying body for use in, for example, a laser printer. The photosensitive body, having a negative polarity, is constituted by an aluminum tube having a diameter of 30 mm, about 0.05 μm thick charge generating layer made of phthalocyanine formed on the aluminum tube, and about 18 μm thick charge transfer layer made of a hydrazone composition and a polycarbonate. On the periphery of the photosensitive body 202, there are a discharger 301 for uniformly exposing the surface of the photosensitive body 202, a contact charger 204 for uniformly charging the surface of the photosensitive body 202, a laser exposing unit 500 for scanning the photosensitive body 202 with laser beams and forming a latent image corresponding to an image signal, a developing apparatus 208 for developing a toner image from the latent image formed on the photosensitive body 202, and an image transfer section 209 for transferring the developed toner image to a predetermined image transfer medium (paper sheet P). The image forming apparatus further comprises a paper cassette 400 containing paper sheets P, a guide 404 for use in manual paper insertion, and a passage through which paper sheets P are transferred from the cassette 400 or the guide 404 to the image transfer section 209. A pair of aligning rollers 406 and a paper sheet guide 420 are provided in the passage. A transporting guide 416 and a paper transporting passage 410 are arranged in a stage subsequent to the image transfer section 209 and communicate with a fixing apparatus 350. The fixing apparatus 350 comprises a heat roller 350 incorporating a heater lamp 351 and a pressure roller 353 pressed by the heat roller 352. While the paper sheet P is passing between the rollers 352 and 353, the toner image is melted and fixed on the paper sheet P. The heat roller 352 and the pressure roller 353 are surrounded by a lower casing 354 and an upper casing 356, so that heat may not radiate outside to keep a temperature condition necessary for fixing. A cleaner 358 abuts on the heat roller 352 to keep the roller clean so that satisfactory fixing operation can be performed. Further, a thermistor 360 detects the temperature on the surface of the heat roller 351, so that a temperature necessary for fixing can be maintained. A pair of discharge rollers 408 and a discharge tray 14 are provided in a stage subsequent to the fixing apparatus 350. Further, a drum cleaner 210, having an elastic blade member 232 for mechanically removing the toner remaining on the photosensitive body 202, is provided. In the upper casing 356, a paper guide 364 is arranged in upstream proximity to a contact portion 362 between the heat roller 352 and the pressure roller 353, so that the front end of a paper sheet P supplied to the fixing apparatus 350 can be guided accurately between the heat roller 352 and the pressure roller 353. A paper guide 366 is provided on the paper sheet exit side of the fixing apparatus 350, to guide the paper sheet P, on which an image is fixed, to the pair of discharge rollers 408.

Figure 2A:
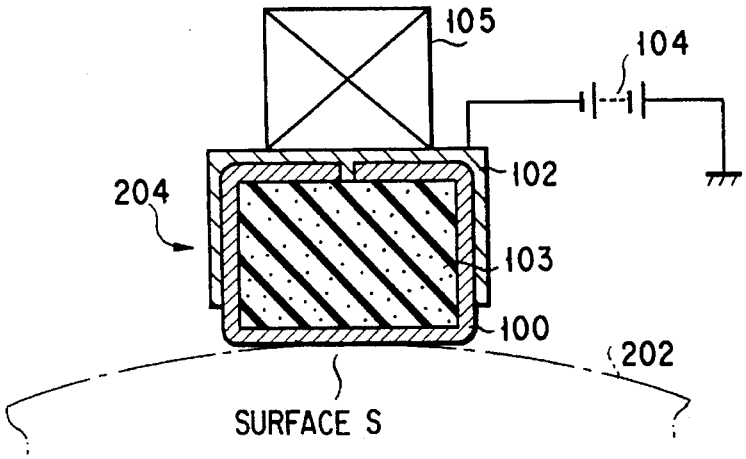
FIG. 2A is a cross-sectional view of a contact charger according to an embodiment of the present invention.

FIG. 2A is an enlarged view showing the contact charger 204 arranged on the periphery of the photosensitive body 202. The contact charger 204 is constituted by a core member 103 made of polyurethane foam (the thickness: 10 mm; the width of the surface to be face the photosensitive body: 16 mm; hardness 5°; trade name: ASKER-C) and conductive nonwoven fabric 100 wound around the core member 103. The conductive nonwoven fabric 100 has a thickness of about 0.4 mm, a volume resistivity of $10^4$ to $10^5$ Ω/□·cm and a surface resistivity of $10^5$ to $10^6$ Ω/□. As a first example, conductive nonwoven fabric is preferably ST poly-conductive nonwoven NEA 003 produced by Achilles Corporation, formed by polymerizing polypyrrole, or a π conjugate conductive polymer, with conductive nonwoven fabric of polyester and nylon. The diameter of a fiber of the conductive nonwoven fabric 100 is about 6 μm. In the first example, since the conductive nonwoven fabric is a polymer of conductive macromolecules, a conductive material such as carbon is not required. Hence, the variation in the electric resistivity due to dispersibility of carbon is very small.

A conductive holder 102 is attached to an exterior surface of the conductive nonwoven fabric 100. The conductive holder 102 for supporting the conductive nonwoven fabric 100 and applying a voltage thereto is a U-shaped metal member made of aluminum, stainless steel or the like. The conductive holder 102 is fixed to the conductive nonwoven fabric 100 by utilizing elasticity of the core member 103. Pressing means 105 is provided on back of the conductive holder 102 to press the conductive nonwoven fabric 100 to the photosensitive body 202 with a predetermined pressure.

Figure 8:
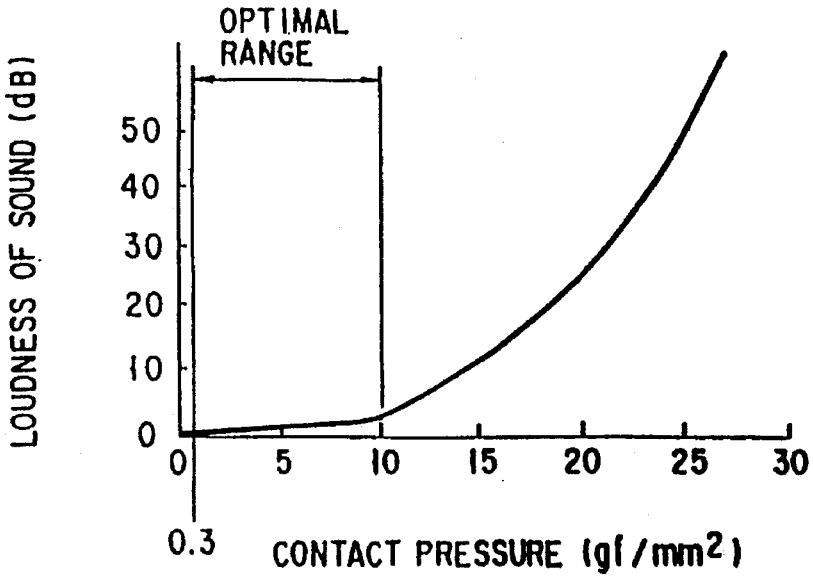
FIG. 8 is a graph showing the relationship between the loudness of sound and the contact pressure of conductive unwoven fabric on the surface of the photosensitive drum.

The conductive holder 102 is electrically connected to a DC constant voltage source 104 serving as voltage applying means, so that a predetermined voltage (at least 400 V of an absolute value) can be applied to the conductive nonwoven fabric 100, serving as a contact element, via the conductive holder 102. The conductive nonwoven fabric 100 is slightly pressed by the pressing means 105 against the photosensitive body 202 in an amount of deformation of about 0.5 to 1.5 mm from the surface of the photosensitive body, or with a contact pressure of about 0.3 to 10 gf/mm$^2$. The amount of deformation in a central portion of the conductive unwoven fabric 100 is different from that in a peripheral portion thereof. The above range of the amount of deformation is the maximum value of the deformation amount in the central portion. FIG. 8 shows the relationship between the contact pressure and the loudness of the sound. As evident from FIG. 8, the loudness of the sound is greatly increased, when the contact pressure exceeds 10 gf/mm$^2$. This is inappropriate for practical use. When the contact pressure is less than 0.3 gf/mm$^2$, nip defect occurs. Therefore, 0.3 to 10 gf/mm$^2$ is an optical range of the contact pressure.

Figure 2B:
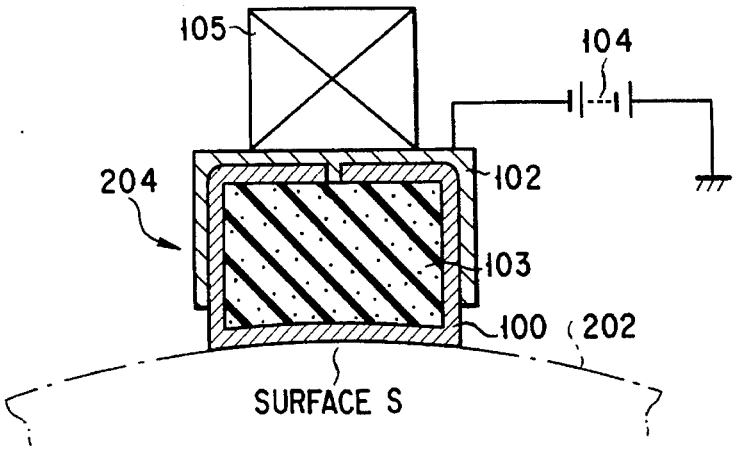
FIG. 2B is a cross-sectional view of a contact charger according to another embodiment of the present invention.

In an example of FIG. 2B, the surface of the conductive unwoven fabric 100 which is brought into contact with the photosensitive body 202 is curved along the surface of the photosensitive body 200. With this structure, the amount of deformation is the same both in central and peripheral portions, with the result that the conductive nonwoven fabric 100 can be uniformly pressed against the photosensitive body over the entire width of the nip under a low pressure. Consequently, an image with a smaller number of white stripes can be produced.

Figure 2C:
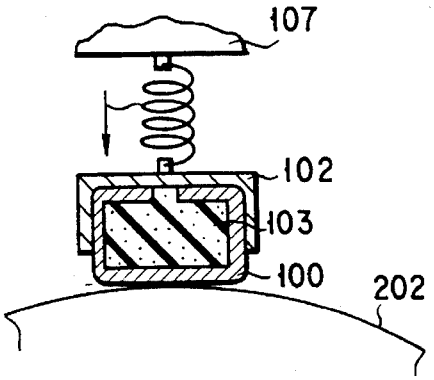
FIG. 2C is a cross-sectional view of an example of pressing means of the contact charger of the present invention.

FIG. 2C shows another example of the pressing means 105. In this example, a plurality of (e.g., three) compressing coil springs 105*a* are attached to places between a holder 102 and a main body 107 along the longitudinal direction of the conductive nonwoven fabric 100, so as to press the conductive nonwoven fabric 100 against the photosensitive body 202.

Figure 2D:
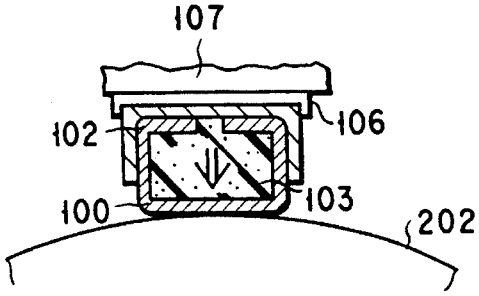
FIG. 2D is a cross-sectional view of another example of pressing means of the contact charger of the present invention.

FIG. 2D shows still another example of the pressing means 105. In this example, a holder 102 is fixed to a main body 107 via a fixing member 106 with a screw or adhesive, so that the conductive nonwoven fabric 100 can be pressed against the photosensitive body 202 by utilizing elasticity of the core member 103.

Figure 3:
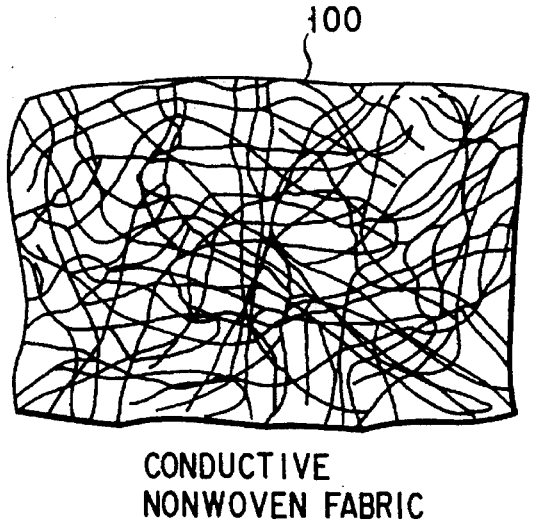
FIG. 3 is a schematic diagram showing a surface of the contact charger of the present invention, which is brought into contact with a photosensitive drum.

FIG. 3 is a schematic diagram showing the surface (a surface S shown in FIG. 2A) the conductive nonwoven fabric 100 of the present invention, from the viewpoint of the drum photosensitive body, observed on a microscopic level. The conductive nonwoven fabric 100 is formed of a number of fibers entangled in various directions. Therefore, the ends of the fibers scarcely protrude from the surface. In other words, most part of the fiber surface is brought into contact with the photosensitive body 202, unlike the structure of the conventional brush in which the ends of the fibers, which are bent, are brought into contact with the photosensitive body.

The nonwoven fabric used in this embodiment can be any chemical fiber other than nylon or polyester, for example, acrylic or rayon, so long as it is "a cloth-like material having a web or mat structure in which fibers are bonded together by adhesive" according to the definition of ASTM and made of cloth or sheet-like fibers produced without using a spinning machine, a weaving machine, or a knitting machine. Although the above-mentioned fibers are classified as dry unwoven fabric, it is possible to wet nonwoven fabric such as paper, after being subjected to a conducting process.

In the first example, ST poly-conductive nonwoven NEA 003 produced by Achilles Corporation, formed by polymerizing polypyrrole (i.e., conductive macromolecules) is used as a contact element which is brought into contact with the photosensitive body. However, it can be replaced by any other conductive non-woven fabric.

As a second example of conductive nonwoven fabric obtained by the following process can be used: carbon black or metal powder is dispersed with a resin such as rayon, nylon or polyester, and fabric itself is subjected to a conducting process.

As a third example of conductive nonwoven fabric obtained by the following process can be used: the insulative nonwoven fabric such as polyester or nylon is immersed in a solvent containing thermoplastic, carbon, toluene, and the like, thereby forming a conductive coating layer, which is coated on the fabric.

As a fourth example of conductive nonwoven fabric, synthetic fiber obtained by carbonizing nonwoven fabric such as rayon under a low pressure can be used.

In this embodiment, a DC constant voltage source is used as the voltage applying means 104, since it provides a satisfactorily stable charge potential in a longitudinal direction of the photosensitive body 202, when an image is to be printed on a small size of paper sheet. When a constant current source is used, a positive transfer charge is applied to the surface of the photosensitive body 202 via a paper sheet in a transfer apparatus 300 upstream in a rotational direction of the photosensitive body 202. At this time, if the paper sheet is of small size, a positive charge is directly applied to a portion of the surface of the photosensitive body 202 and it is impossible to eliminate the potential difference in a charging operation.

As a second example of the voltage applying means 104, AC voltage applying means can be used. For example, a DC voltage of −1.0 KV is superposed on an AC voltage of 1.2 KV in a peak-to-peak value, at a frequency of 1 KHz. with use of such a voltage applying means, stable charge characteristics, without unevenness in charge, can be obtained.

Figure 4:
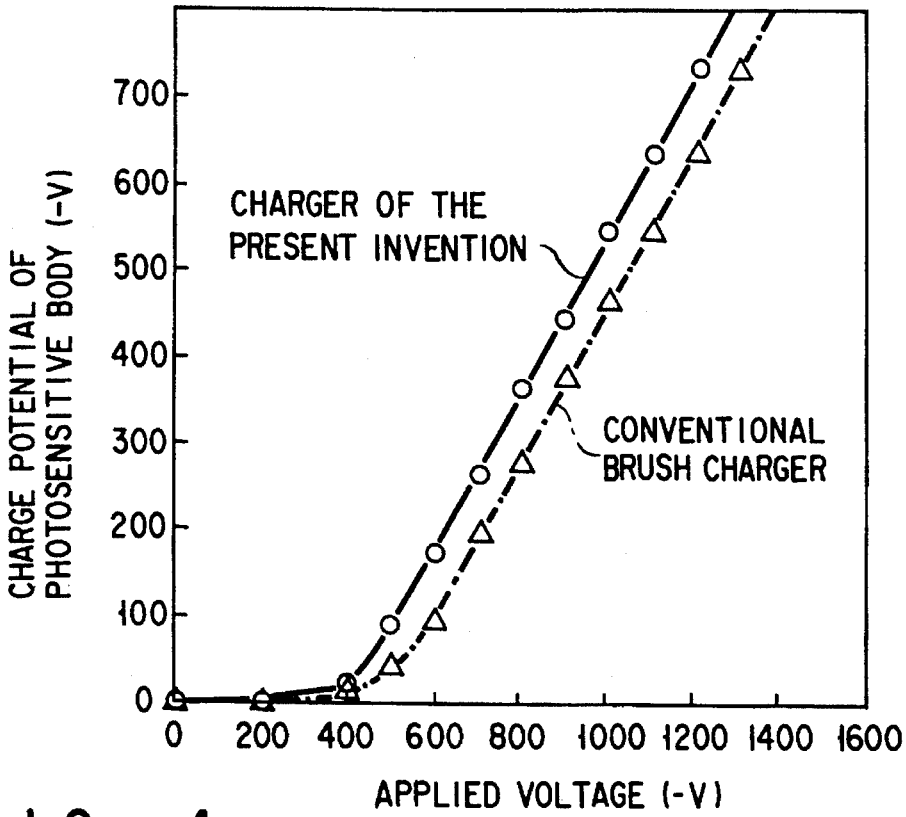
FIG. 4 is a graph showing the relationship between the charge potential of the photosensitive body and the applied voltage in the contact charger of the present invention and in the conventional contact charger.

The present inventors inspected photosensitive body charging characteristics of the contact charger comprising the conductive nonwoven fabric according to the present invention shown in FIG. 2. The results of the inspection are shown in FIG. 4. As evident from FIG. 4, the contact charger of the present invention has the same function as the conventional brush charger with respect to a rising voltage of about −400 V or greater.

Figure 5:
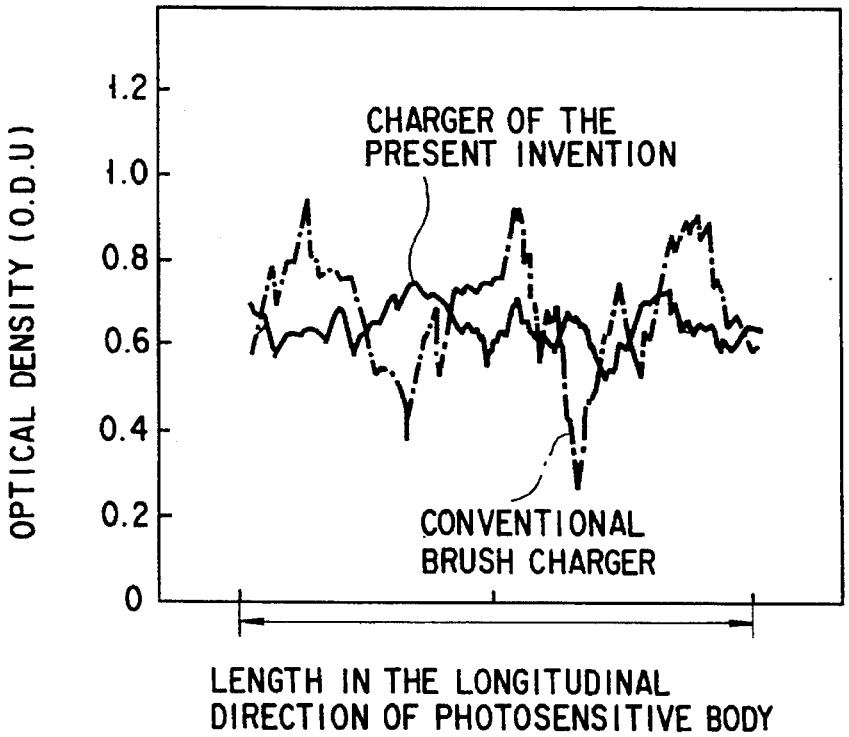
FIG. 5 is a graph showing the optical density along the longitudinal direction of the photosensitive drum of the contact charger of the present invention and the conventional contact charger.

The present inventors also inspected optical densities in a desired width of an output image, in order to detect unevenness in the potential in the longitudinal direction of the photosensitive body 202 charged by the contact charger comprising conductive nonwoven fabric according to the present invention. For this purpose, the developing bias voltage applied to the developing apparatus 208 in the image forming apparatus shown in FIG. 1 is increased from −400 V near the charge potential of −600 V, thereby outputting a half-tone image. The results of the inspection are shown in FIG. 5. As evident from FIG. 5, the unevenness in charge is greatly reduced in the contact charger of the present invention, as compared to the conventional brush charger. More specifically, the deviation of the optical densities of the contact charger of the present invention is as low as 0.05 to 0.10, whereas the deviation of the optical densities of the conventional blush charger is 0.25 to 0.35.

The following are descriptions of results of an experiment, on an appropriate electrical resistance of the conductive nonwoven fabric serving as a contact element of the contact charger of the present invention.

Figure 6:
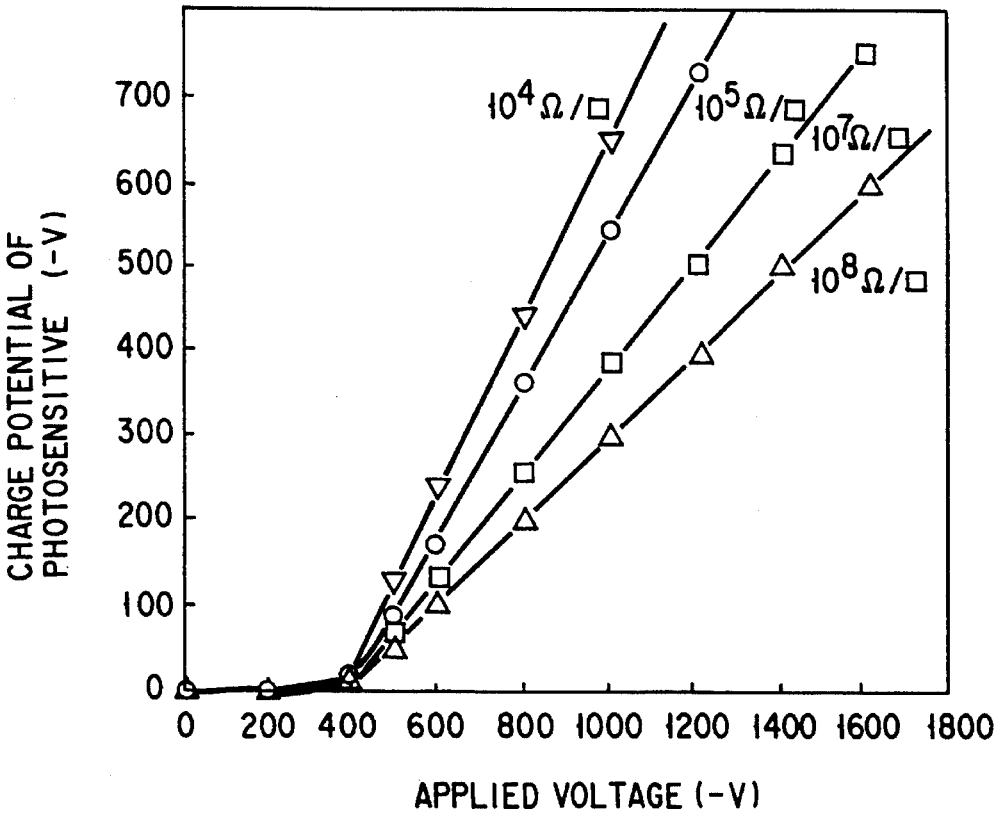
FIG. 6 is a graph showing the relationship between the charge potential of the photosensitive body and the applied voltage in the contact charger of the present invention in various surface resistivities of conductive unwoven fabric.

FIG. 6 shows the relationship between the charge characteristic and the surface resistivity of conductive nonwoven fabric serving as a contact element. As the surface resistivity of the conductive nonwoven fabric increases, a voltage necessary for charging the photosensitive body to a predetermined potential is shifted to a higher side. In this embodiment, the charge current necessary to charge the photosensitive body to the potential of −600 V is about $4.0\times10^{-8}$ μ/cm for any surface resistivities.

Figure 7:
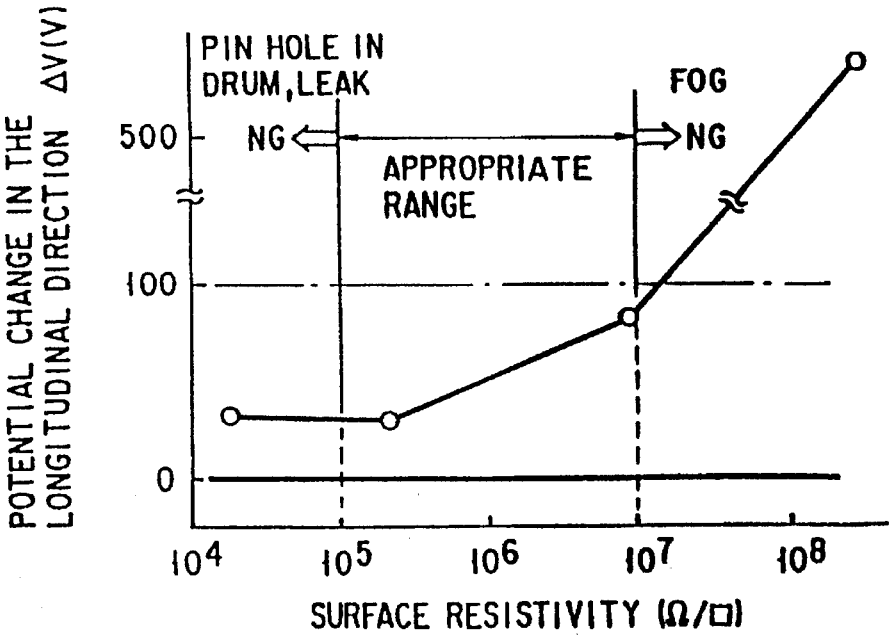
FIG. 7 is a graph showing the relationship between the potential change in the longitudinal direction and the surface resistivity of conductive unwoven fabric.

When the surface resistivity exceeds $10^7$ Ω/□, the charge becomes suddenly uneven as shown in FIG. 7. The unevenness in charge is presented as fog like black belts in the longitudinal directions on an image or unevenness in diameters in dots of a mesh image. This phenomenon results from the contact resistance generated when the contact element is brought into contact with the photosensitive body, rather than the difference in the surface resistivity of the fiber, when the electric resistance is high. In contrast, when the surface resistivity is low, the unevenness in charge in the longitudinal direction of the photosensitive body is greatly reduced. However, when the surface resistivity is less than $10^5$ Ω/□, an over-current flows through pin holes of the photosensitive body, resulting in leak and combustion of the leaked portion. Therefore, the suitable range of the surface resistivity is set to $10^5$ to $10^7$ Ω/□.

In the conductive nonwoven fabric of the above embodiment (ST poly-conductive nonwoven fabric produced by Achilles Corporation), the volume resistivity and the surface resistivity are correlative to each other. The suitable range of the volume resistivity is about $10^4$ to $10^6$ Ω·cm.

An operation of the image forming apparatus of the above embodiment will now be described.

As the drum photosensitive body 202 is rotated, the discharger 301 uniformly exposes the surface of the photosensitive body 202. The contact charger is pressed against the photosensitive body at a predetermined pressure. A voltage of about −1.1 KV is applied by the voltage applying means 104 shown in FIG. 2 through the conductive holder 102 to the conductive nonwoven fabric 100. As a result, the photosensitive body 202 is uniformly charged to about −600 V by the contact charger 204. The charged photosensitive body 202 is scan-exposed by laser beams using the laser exposing unit 500, thereby forming a latent image corresponding to an image signal. The latent image formed on the photosensitive body 202 is developed into a toner image by the developing apparatus 208 using a two-component developer, for example. The toner image is transferred to the image transfer section 209.

In synchronism with the toner image forming operation, a paper sheet P picked up from the cassette 400 or manually inserted through the guide 404 is supplied to the image transfer section 209 through the pair of aligning rollers 406 and the paper sheet guide 420. The toner image formed on the photosensitive body 202 is transferred to the paper sheet P through the function of the transfer apparatus 300. Then, the paper sheet P is guided by the transporting guide 416, passed through the paper transporting path 410, and supplied to the fixing apparatus 350. The toner image is melted and fixed to the paper sheet P. Thereafter, the paper sheet P is discharged to the discharge tray 14 through the pair of discharge rollers 408.

After the toner image is transferred to the paper sheet P, residual toner on the photosensitive body 202 is mechanically removed from the photosensitive body by means of the drum cleaner 210 comprising the elastic blade member 232.

As has been described above, according to the contact charger having conductive nonwoven fabric and the image forming apparatus of the present invention, the conductive nonwoven fabric, i.e., the contact element, is brought into surface contact with the image carrying body, thereby preventing charge unevenness, fog like black belts in the longitudinal directions on an image, and unevenness in diameters in dots of a mesh image. Further, even if a pin hole is formed in the photosensitive body, an over-current does not flow through the pin hole. Thus, reduction of the charge potential or combustion of the conductive unwoven fabric itself can be prevented.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A contact charger for charging an object, comprising:

conductive nonwoven fabric in surface contact with the object;

voltage applying means for applying a voltage to the conductive nonwoven fabric so as to charge the object; and pressing means for pressing the conductive nonwoven fabric against the object under a surface contact pressure of 0.1 to 10 gf/mm$^2$.

2. The contact charger according to claim 1, wherein the conductive nonwoven fabric has a surface electric resistivity of $10^5$ to $10^7$ Ω/□.

3. The contact charger according to claim 1, further comprising conductive holder means, connected to the voltage applying means, for holding the conductive nonwoven fabric.

4. The contact charger according to claim 1, wherein the conductive nonwoven fabric has a configuration in accordance with the surface of the object.

5. The contact charger according to claim 1, wherein the conductive nonwoven fabric is flexible and has a rectangular configuration which changes in accordance with the surface of the object.

6. The contact charger according to claim 1, further comprising:

a core;

said conductive nonwoven fabric covering the core, having a volume resistivity of $10^4$ to $10^5$ Ω·cm and a surface resistivity of $10^5$ to $10^6$ Ω/□;

a conductive holder set on a periphery of the conductive nonwoven fabric; and said voltage applying means comprising a DC constant voltage source, electrically connected to the conductive holder, for charging the object through the conductive holder and the conductive nonwoven fabric.

7. A contact charger for charging an object, comprising:

conductive nonwoven fabric in surface contact with the object;

voltage applying means for applying a voltage to the conductive nonwoven fabric so as to charge the object; and pressing means for pressing the conductive nonwoven fabric against the object, so that the conductive nonwoven fabric is brought into surface contact with the object and deformed in an amount of about 0.5 to 1.5 mm from the surface of the object.

8. The contact charger according to claim 7, wherein the conductive nonwoven fabric has a surface electric resistivity of $10^5$ to $10^7$ Ω/□.

9. The contact charger according to claim 7, further comprising conductive holder means, connected to the voltage applying means, for holding the conductive nonwoven fabric.

10. The contact charger according to claim 7, wherein the conductive nonwoven fabric has a configuration in accordance with the surface of the object.

11. The contact charger according to claim 7, wherein the conductive nonwoven fabric is flexible and has a rectangular configuration which changes in accordance with the surface of the object.

12. The contact charger according to claim 7, further comprising:

a core;

said conductive nonwoven fabric covering the core, having a volume resistivity of $10^4$ to $10^5$ Ω·cm and a surface resistivity of $10^5$ to $10^6$ Ω/□;

a conductive holder set on a periphery of the conductive nonwoven fabric; and said voltage applying means comprising a DC constant voltage source, electrically connected to the conductive holder, for charging the object through the conductive holder and the conductive nonwoven fabric.

13. An image forming apparatus, comprising:

charging means for charging a photosensitive body, the charging means including conductive nonwoven fabric in surface contact with the photosensitive body and voltage applying means for applying a voltage to the conductive nonwoven fabric;

exposing means for exposing the photosensitive body charged by the charging means, so as to form a latent image on the photosensitive body;

developing means for supplying a developer to the photosensitive body on which the latent image is formed, thereby forming a developed image on the photosensitive body; and pressing means for pressing the conductive nonwoven fabric against the photosensitive body under a surface contact pressure of 0.1 to 10 gf/mm$^2$.

14. The image forming apparatus according to claim 13, wherein the conductive nonwoven fabric has a surface electric resistivity of $10^5$ to $10^7$ Ω/□.

15. The image forming apparatus according to claim 13, further comprising conductive holder means, connected to the voltage applying means, for holding the conductive nonwoven fabric.

16. The image forming apparatus according to claim 13, wherein the conductive nonwoven fabric has a configuration in accordance with the surface of the photosensitive body.

17. The image forming apparatus according to claim 13, wherein the conductive nonwoven fabric is flexible and has a rectangular configuration which changes in accordance with the surface of the photosensitive body.

18. The image forming apparatus according to claim 13, wherein the charging means comprises:

a core;

said conductive nonwoven fabric covering the core, having a volume resistivity of $10^4$ to $10^5$ Ω·cm and a surface resistivity of $10^5$ to $10^6$ Ω/□;

a conductive holder set on a periphery of the conductive nonwoven fabric; and said voltage applying means comprising a DC constant voltage source, electrically connected to the conductive holder, for charging the object through the conductive holder and the conductive nonwoven fabric.

19. An image forming apparatus, comprising:

charging means for charging a photosensitive body, the charging means including conductive nonwoven fabric in surface contact with the photosensitive body and voltage applying means for applying a voltage to the conductive nonwoven fabric;

exposing means for exposing the photosensitive body charged by the charging means, so as to form a latent image on the photosensitive body;

developing means for supplying a developer to the photosensitive body on which the latent image is formed, thereby forming a developed image on the photosensitive body; and pressing means for pressing the conductive nonwoven fabric against the object, so that the conductive nonwoven fabric is brought into surface contact with the object and deformed in an amount of about 0.5 to 1.5 mm from the surface of the object.

20. The image forming apparatus according to claim 19, wherein the conductive nonwoven fabric has a surface electric resistivity of $10^5$ to $10^7$ Ω/□.

21. The image forming apparatus according to claim 19, further comprising conductive holder means, connected to the voltage applying means, for holding the conductive nonwoven fabric.

22. The image forming apparatus according to claim 19, wherein the conductive nonwoven fabric has a configuration in accordance with the surface of the photosensitive body.

23. The image forming apparatus according to claim 19, wherein the conductive nonwoven fabric is flexible and has a rectangular configuration which changes in accordance with the surface of the photosensitive body.

24. The image forming apparatus according to claim 19, wherein the charging means comprises:

a core;

said conductive nonwoven fabric covering the core, having a volume resistivity of $10^4$ to $10^5$ Ω·cm and a surface resistivity of $10^5$ to $10^6$ Ω/□;

a conductive holder set on a periphery of the conductive nonwoven fabric; and said voltage applying means comprising a DC constant voltage source, electrically connected to the conductive holder, for charging the object through the conductive holder and the conductive nonwoven fabric.

* * * * *